US006182794B1

(12) United States Patent
Lee

(10) Patent No.: US 6,182,794 B1
(45) **Date of Patent: *Feb. 6, 2001**

(54) OIL SUCTION DEVICE FOR HERMETICALLY SEALED COMPRESSOR

(75) Inventor: Ho Soo Lee, Kyungsangnam-Do (KR)

(73) Assignee: LG Electronics, Inc. (KR)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/957,594

(22) Filed: Oct. 24, 1997

(51) Int. Cl.[7] ..... F04B 39/02
(52) U.S. Cl. ..... 184/6.18; 92/153
(58) Field of Search ..... 184/6.16, 6.18; 418/94; 92/153

(56) References Cited

U.S. PATENT DOCUMENTS

| | | | | |
|---|---|---|---|---|
| 4,209,080 | * | 6/1980 | Douglas | 184/6.16 |
| 4,375,944 | * | 3/1983 | Wolf | 184/6.16 |
| 4,865,527 | * | 9/1989 | Piera et al. | 184/6.16 |
| 5,228,843 | * | 7/1993 | Novolan et al. | 184/6.18 |
| 5,498,143 | * | 3/1996 | Dreiman et al. | 184/6.18 |
| 5,803,718 | * | 9/1998 | Woo | 184/6.16 |

FOREIGN PATENT DOCUMENTS

| | | | | |
|---|---|---|---|---|
| 50-87512 | * | 12/1948 | (JP) | 418/94 |
| 58-131394 | * | 8/1983 | (JP) | 418/94 |
| 61-8491 | * | 1/1986 | (JP) | 418/94 |

* cited by examiner

*Primary Examiner*—C. Williams
*Assistant Examiner*—Chong H. Kim
(74) *Attorney, Agent, or Firm*—Ostrolenk, Faber, Gerb & Soffen, LLP

(57) ABSTRACT

An oil suction propeller structure for a hermetically sealed compressor includes a rotor, a crank shaft pressure-inserted in the rotor, an oil guide piece pressure-inserted in a lower portion of the crank shaft, a lower wing fixedly inserted in the oil guide piece and soaked in an oil, an upper wing having a width thereof wider than that of the lower wing, and an intermediate portion extending from the lower wing and gradually broadening in width toward the upper wing. The oil suction propeller structure improves oil supply capacity, and minimizes a whirling sound and a dropping noise which may occur during the rotation of the oil guide piece and the oil suction propeller thereof, for thereby enhancing reliability of the hermetically sealed compressor.

3 Claims, 4 Drawing Sheets

OIL SUCTION DEVICE FOR HERMETICALLY SEALED COMPRESSOR

BACKGROUND OF THE INVENTION

1. Field of the Invention

The present invention relates to a propeller structure for a hermetically sealed compressor, and more particularly to an improved propeller structure for a hermetically sealed compressor capable of enhancing an oil supply capacity and minimizing a whirling sound and a dropping noise which may occur during rotation of a piece and a propeller thereof, by gradually broadening a wing of the propeller in width from bottom to top.

2. Description of the Prior Art

As shown in FIG. 1, a conventional hermetically sealed compressor includes a hermetic container 1 having an upper and lower cells 1*a*, 1*b*, and a motor unit 3 provided in the hermetic container 1 and having a rotor 3*a* and a stator 3*b*.

An end of each of a plurality of support springs 4 is connected at a side portion along an inner periphery of the lower cell 1*b*, and another end of each of the support springs 4 supports a frame 2.

A crank shaft 5 having an eccentric portion 6 at an upper portion thereof is heat-inserted into the hole in the rotor 3*a*. A cylinder 7 is connected to an upper portion of the frame 2.

A piston 8 that horizontally shuttles in the cylinder 7 is engaged to the eccentric portion 6 of the crank shaft 5.

A valve plate 9 is attached onto an end portion of the cylinder 7, and a head cover 10 is attached onto the valve plate 9. A suction muffler (not shown) is mounted on a portion of the head cover 10.

With reference to FIG. 2, in order to suck a oil "O" in through the crank shaft 5, a cylinder type oil guide piece 11 is pressure-inserted into the crank shaft 5 which becomes rotated in accordance with the rotor 3*a*.

An oil suction propeller 12 is fixedly inserted into the oil guide piece 11.

At this time, respective widths of an upper and lower wings 12*a*, 12*b* comprising the suction propeller 12 are identical to each other, and the lower wing 12*b* of the oil suction propeller 12 is dipped in the oil "O".

The oil "O" kept in a lower portion of the hermetic container 1 is upwardly sucked by the rotation of the crank shaft 5 and scattered over the crank shaft 5. The scattered oil "O" is soaked through respective friction portions in the compressor for thereby preventing overheating and abrasion.

The oil sucking steps of the thusly constituted hermetically sealed compressor will now be described with reference to FIG. 2.

First, when an electrical power is supplied to the hermetically sealed compressor, the rotor 3*a* starts its rotation. Accordingly, as the crank shaft 5 heatinserted into the rotor 3*a* becomes rotated, the oil guide piece 11 and the oil suction propeller 12 become rotated. The thusly generated centrifugal force and an thrust force serve to upwardly suck the oil "O". At this time, the centrifugal force and the thrust force are variable depending on respective diameters of the oil guide piece 11 and the oil suction propeller 12.

That is, the more increased become the respective diameters of the upper and lower oil suction propeller wings 12*a*, 12*b*, the stronger the centrifugal force and the thrust force, and the more oil "O" is upwardly sucked. To the contrary, as the respective diameters of the upper and lower oil suction propeller wings 12*a*, 12*b* become smaller, so does the amount of the oil "O" being upwardly sucked resulting from the decreased centrifugal force and the thrust force.

However, in the oil suction propeller structure of the conventional hermetically-sealed compressor, as shown in FIG. 3, although the sucked-up amount of the oil becomes increased when the respective diameters of the oil guide piece and the oil suction propeller are increased, the oil portion that is in contact with the outer periphery of the oil guide piece may be whirled during the oil suction propeller rotation for thereby generating noise caused by a whirling and a dropping of the oil "O".

Further, when the respective diameters of the oil guide piece and the oil suction propeller are decreased for preventing the whiling and dropping noise, the centrifugal force and the thrust force are also decreased, for thereby deteriorating an oil supplying capacity.

SUMMARY OF THE INVENTION

Accordingly, it is an object of the present invention to provide an oil suction propeller structure for a hermetically sealed compressor for minimizing a whirling and dropping noise that may occur due to a whirl current of an oil during a rotation of an oil guide piece and an oil suction propeller as well as preventing the oil supply capacity from being deteriorated.

To achieve the above-described object, there is provided an oil suction propeller structure for a hermetically sealed compressor according to the present invention which includes a rotor, a crank shaft pressure-inserted in the rotor, an oil guide piece pressure-inserted in a lower portion of the crank shaft, a lower wing fixedly inserted in the oil guide piece and soaked in an oil, an upper wing having a width thereof wider than that of the lower wing, and an intermediate portion extending from the lower wing and gradually broadening in width toward the upper wing.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE INVENTION

With reference to the accompanying drawings, the oil suction propeller structure of an hermetically sealed compressor according to the present invention will be described.

Figure 1:
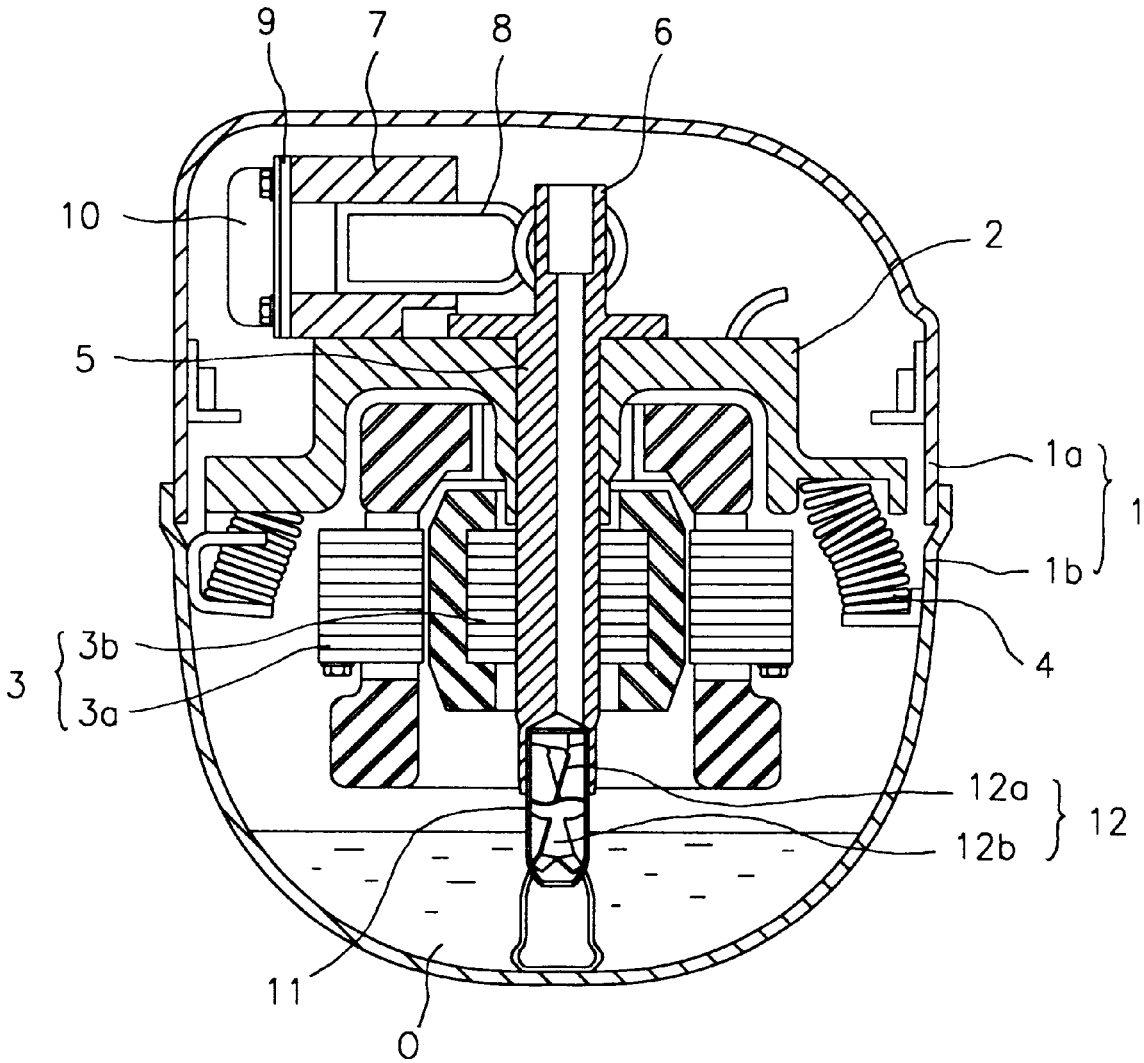
FIG. 1 CONVENTIONAL ART
FIG. 1 is a cross-sectional view illustrating a conventional hermetically sealed compressor.
Figure 2:
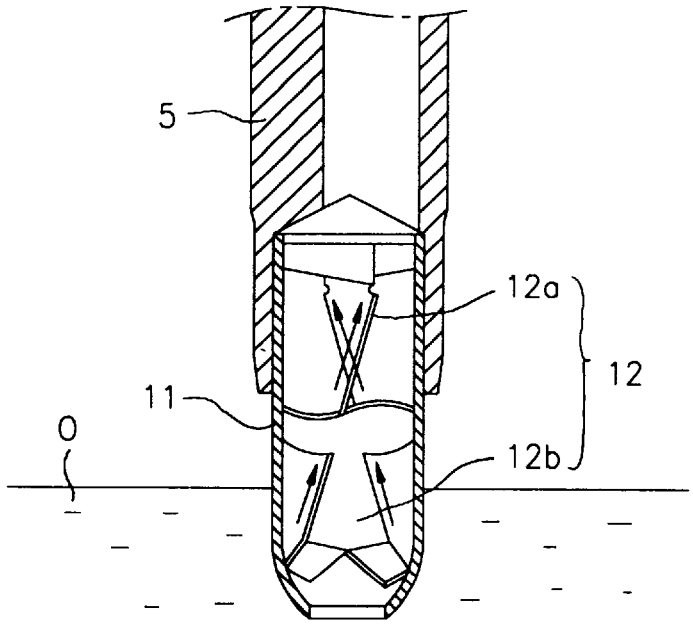
FIG. 2 CONVENTIONAL ART
FIG. 2 is a cross-sectional partial view detailing an oil suction propeller structure of the conventional hermetically sealed compressor.
Figure 3:
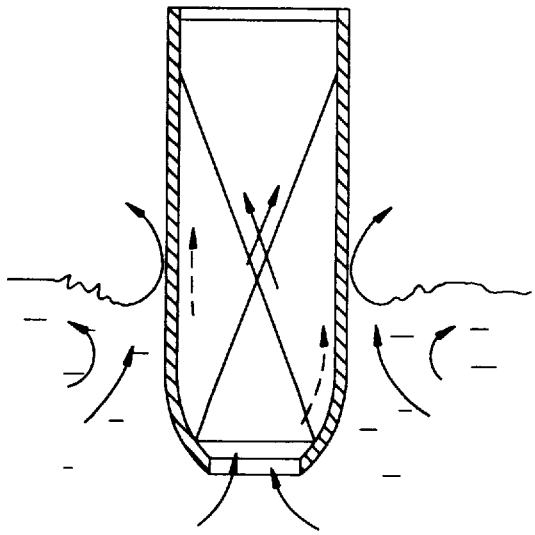
FIG. 3 CONVENTIONAL ART
FIG. 3 is a cross-sectional view of the oil suction propeller structure illustrating an oil the conventional hermetically sealed compressor.
Figure 4:
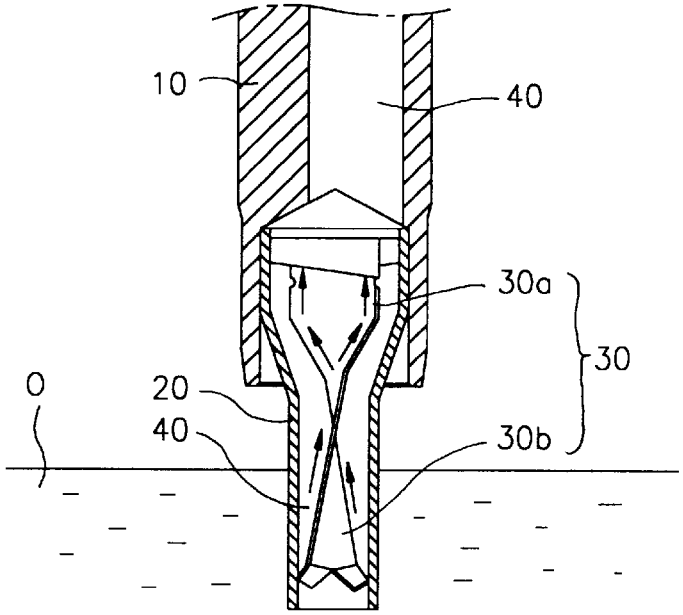
FIG. 4 is a cross-sectional partial view detailing an oil suction propeller structure of a sealed compressor according to the present invention.

As shown in FIG. 4, the oil suction propeller structure of the present invention becomes vertically narrowed from top to bottom in respective diameters of a crank shaft 10, which is pressure-inserted in a rotor (not shown) and having an oil path 40 along the axis therethrough, and of an oil guide piece 20 which is pressure-inserted in a lower portion of the crank shaft 10. That is, the crank shaft 10 and the oil guide piece 20 are narrower in their lower portions than in their upper portions.

Figure 5:
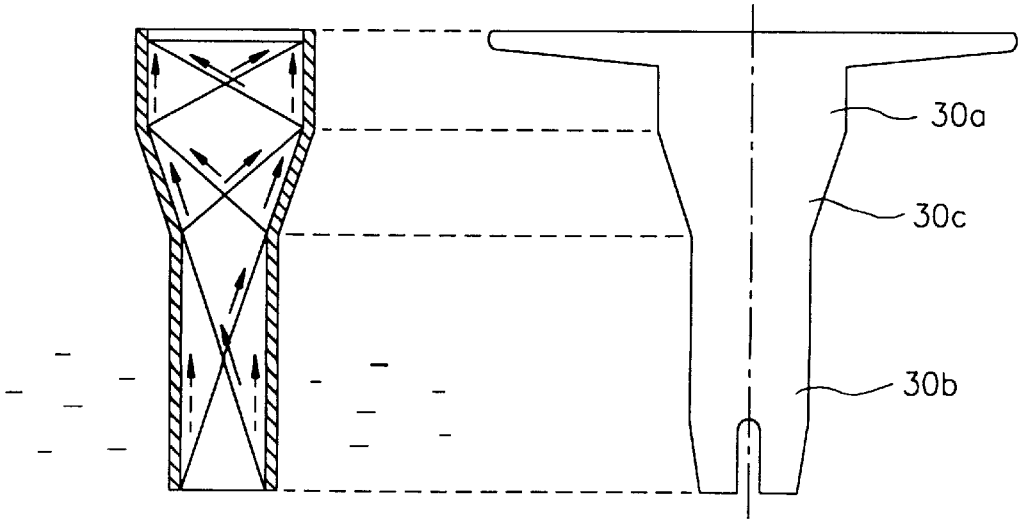
FIG. 5 is a cross-sectional partial view illustrating the flow of oil in the oil suction propeller structure of a hermetically sealed compressor according to the present invention.

Specifically, as shown in FIG. 5, an oil suction propeller 30 fixedly inserted in the oil guide piece 20 has an upper wing 30*a* and a lower wing 30*b*, wherein the lower wing 30*b* portion which is in contact with the oil "O" is narrow compared to the upper wing 30*a* portion. An intermediate portion 30*c* extending from the upper wing 30*a* to the lower wing 30*b* becomes gradually wider from low to high until it reaches up to the upper wing 30*a*.

The operation of the thusly constituted oil suction propeller structure will now be described.

When the crank shaft 10 starts rotation, the oil guide piece 20 and the oil suction propeller 30 respectively engaged to the crank shaft 10 rotate on the common axis thereof. At this time, a central portion of the oil guide piece 20 becomes a rotational center for thereby generating a centrifugal force.

Accordingly, the oil suction propeller structure decreases a whirling sound and a dropping noise by narrowing the lower width of the oil guide piece 20 and the oil suction propeller 30, while improving a suction capability of the oil "O" by widening an upper portion of the oil suction propeller 30.

Figure 6A:
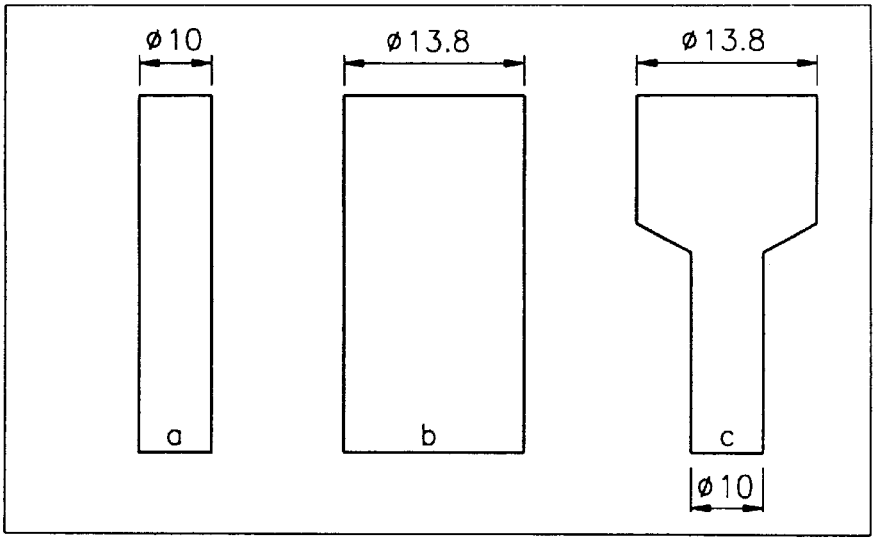
FIG. 6A is a graph for comparing the conventional oil guide piece to the oil guide piece according to the present invention.
Figure 6B:
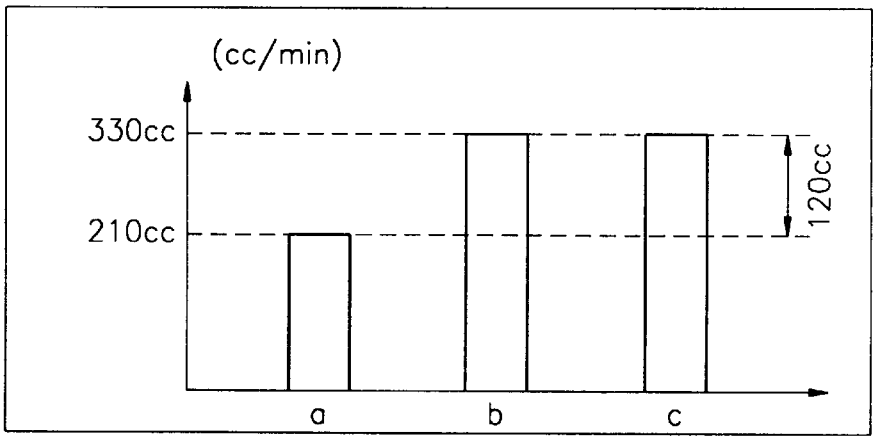
FIG. 6B is a graph for illustrating an oil supply to oil guide pieces having different widths.
Figure 6C:
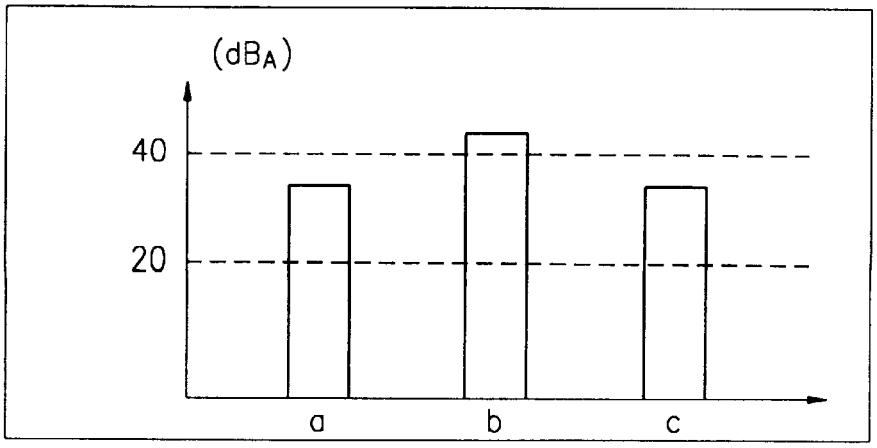
FIG. 6C is a graph for illustrating noise amounts with regard to oil guide pieced having different widths.

With reference to FIGS. 6A through 6C, the effects with regard to the oil guide piece employed in the oil suction propeller structure of the hermetically sealed compressor according to the present invention will now be explained in comparison to the conventional oil guide piece.

In FIG. 6A, there are provided three oil guide pieces having different widths respectively, and the respective oil suction propellers inserted in the respective oil guide pieces also differ from one another in width. The measurement is carried out under an identical condition.

Here, in each of FIGS. 6A–6C, "a" denotes a conventional oil guide piece having a width of Ø10, "b" indicates another conventional oil guide piece having a width of Ø13.8.

An oil guide piece "c" according to the present invention is provided with its upper width of Ø13.8 and its lower width of Ø10, wherein the lower portion of the oil guide piece with the lower width of Ø10 remains soaked in the oil "O".

A vertical axis of the graph in FIG. 6B indicates an oil supply per minute (cc/min), and a horizontal axis of the graph in FIG. 6C denotes noise (dBA).

The conventional oil guide piece "a" having its width of Ø10 in FIG. 6A is small as disclosed in the oil guide piece "a" in FIG. 6C, and the thusly generated noise becomes 40 dBA. However, in accordance with the decreased centrifugal force and thrust force, the oil supply capacity becomes 210 cc/min as shown in FIG. 6B, for thereby deteriorating the oil supply capacity by 120 cc/min, compared to "c" in FIG. 6B. Also, the oil guide piece "b" in FIG. 6A has its width of Ø13.8, and the width of the conventional oil guide piece "b" in FIG. 6B is large, and accordingly its centrifugal force and the thrust force become large, for thereby enabling the oil supply to reach its target amount. However, as shown in "c" of FIG. 6C, the noise level remains higher than 4OdBA.

In order to overcome such disadvantages of the conventional oil guide pieces, the present invention provides the oil guide piece having a width of Ø13.8 in its upper portion and a width of Ø10 in its lower portion, so that the oil supply may be at a rate of 330 cc/min as shown in "c" of FIG. 6B, whereby the oil supply amount becomes equivalent to that of the conventional oil guide piece "b" with its width of Ø13.8.

Also, as shown in "c" of FIG. 6C, the oil guide piece noise according to the present invention becomes equivalent to that of the conventional oil guide piece having its width of Ø10. That is, the present invention improves an oil supply capability and significantly decreases noise.

As described above, the oil suction propeller structure of an hermetically sealed compressor allows the improved oil supply capacity to enhance reliability of the hermetically sealed compressor.

Further, the present invention minimizes a whirling sound and a dropping noise which may occur during the rotation of the oil guide piece and the oil suction propeller thereof.

What is claimed is:

1. An oil suction device in a hermetically sealed compressor, said compressor comprising:

a rotor;

a crank shaft pressure-inserted in the rotor;

an oil guide piece formed in a three tiered conical shape and adapted to be pressure-inserted in a lower portion of the crank shaft;

an oil suction propeller fixedly inserted in the oil guide piece, the oil suction propeller being formed in a three tiered conical shape containing a lower portion, an upper portion and an intermediate portion extending between the lower and upper portions;

wherein the suction propeller is inserted in the crank shaft of the hermetically sealed compressor the lower portion soaked in oil in said compressor, the upper portion having a width wider than that of the lower wing; and the intermediate portion gradually broadening in width toward the upper portion, the upper portion and lower portion being twisted relative to the intermediate portion.

2. The compressor of claim 1, wherein the oil guide piece structurally matches the given structural shape of the oil suction propeller.

3. The compressor of claim 1, wherein a width of an upper portion of the oil guide piece and a width of a lower portion thereof are in a ratio of 13.8 to 10 relative to one another.

* * * * *